United States Patent [19]

Kuo

[11] Patent Number: 5,062,728

[45] Date of Patent: Nov. 5, 1991

[54] DENTIFRICE DISPENSING TOOTHBRUSH WITH REPLACEABLE CARTRIDGE

[76] Inventor: Youti Kuo, 88 Foxbourne Rd., Penfield, N.Y. 14526

[21] Appl. No.: 563,307

[22] Filed: Jul. 31, 1990

[51] Int. Cl.[5] ..... B43K 5/06; B43K 5/18; A46B 11/00

[52] U.S. Cl. ..... 401/176; 401/150; 401/280; 401/268

[58] Field of Search ..... 401/143, 146, 149, 176, 401/150, 174, 286, 268, 270, 272, 273, 275, 278, 279, 283, 280

[56] References Cited

U.S. PATENT DOCUMENTS

| | | | |
|---|---|---|---|
| 2,294,285 | 8/1942 | Chu | 401/143 |
| 2,987,743 | 6/1961 | Capps | 401/143 |
| 3,816,007 | 6/1974 | Fox | 401/146 |
| 4,685,819 | 8/1987 | Endo | 401/286 |
| 4,787,765 | 11/1988 | Kuo | 401/150 |

*Primary Examiner*—Danton D. DeMille
*Attorney, Agent, or Firm*—Fred L. Denson

[57] ABSTRACT

A dentifrice dispensing toothbrush is described which locks itself to prevent further pumping of dentifrice material when its replaceable supply cartridge is empty. The self locking mechanism eliminates the formation of voids in the material and consequent pump failure when the spent cartridge is replaced with a new one and material pumped therefrom. The toothbrush also includes a detachable brush head which is slidable to various positions to enhance cleaning after it is used. One embodiment of the invention includes a toothbrush having (1) a housing which has a body and a neck, (2) a reservoir situated within the housing body, (3) a removable cartridge positioned within the reservoir for storing dentifrice material, (4) a pumping means comprising a piston with an orifice for applying a pumping force to the dentifrice material to cause a controlled quantity of it to flow from the cartridge and through its orifice, (5) a detachable brush head having a platform with an opening therethrough and to which a series of bristles are attached, (6) a plunger for driving the piston which is slidably attached to the neck of the housing and to the brush head, (7) a hollow conduit within the plunger having one of its ends in communication with the piston orifice and having its remaining end in communication with the opening in the platform of the brush head so that dentifrice material is able to flow through the hollow conduit and through the opening in the platform to the brush head when a pumping force is applied and (8) locking means comprising a spacer disposed between the piston and the follower disc for preventing movement of the piston when a pumping force is applied and the follower disc is at its terminal position.

16 Claims, 7 Drawing Sheets

88
60
8
84
14
10

88
60
8
84
14
10

88
60
8
84
14
10
84

88
60
8
84
16
14
10
64

74
88
60
92
8
18
20
84
14
10
80
66

DENTIFRICE DISPENSING TOOTHBRUSH WITH REPLACEABLE CARTRIDGE

BACKGROUND OF THE INVENTION

1. Field of the Invention

The present invention relates to a toothbrush which pumps dentifrice material from a replaceable cartridge to the brush head. In particular, the invention provides means which increases the pumping efficiency and which facilitates cleaning the brush head after it is used.

2. Description of the Prior Art

There are a variety of toothbrushes which store and dispense dentifrice material from the handle of the brush. One type of brush dispenses the dentifrice material at the base of the brush head where the bristles are attached, such as that described in U.S. Pat. No. 4,068,974. Another type dispenses dentifrice material directly onto the top of the brush surface. U.S. Pat. No. 4,787,765 describes this type of brush. Most brushes store dentifrice material directly in a reservoir in the brush handle as typified by the brush shown in U.S. Pat. No. 4,269,207. Other brushes store the dentifrice material in a replaceable cartridge which is positioned in the reservoir. U.S. Pat. No. 4,116,570, as well as previously referenced U.S. Pat. Nos. 4,269,207, 4,068,974 and 4,787,765, describe brushes having this feature. Some of the cartridge toothbrushes contain a follower disc which advances in the cartridge as material is pumped therefrom and which serves as a seal to prevent backflow of material. This feature is described in U.S. Pat. Nos. 4,269,207 and 4,787,765. The prior art also includes toothbrushes that store dentifrice material in their handles which have detachable brush heads. Exemplary patents in this regard include U.S. Pat. Nos. 4,269,207 and 4,332,497.

The foregoing discussion illustrates some of the improvements which have been made in the design, structure and operation of toothbrushes that store dentifrice material in their handles. However, the adhesive, paste-like consistency of many dentifrice materials, has resulted in difficulties in consistently providing a smooth, void free flow of material and in cleansing residual material from the brush head after its use. The most widely used dentifrice material, commonly referred to as "toothpaste", is a gel which has an adhesive nature. While this characteristic allows it to remain firm on brush surfaces during periods of use, it also causes it to adhere to the bristles after use as well as to other parts within the toothbrush that are in the flow path. Efficiently cleaning the residual material from the brush is a significant problem in a bottom fed brush because substantial material remains at the base of the brush head, interposed between bristles and the brush surface. Also, residual material remains in the opening at the base of the brush where material is fed to the brush. If material is not thoroughly cleaned from the opening, the material becomes dried and eventually clogs the opening.

Replaceable cartridges having follower discs provide an advantageous alternative for storing dentifrice material directly in a toothbrush reservoir. However, continuous pumping by the user after the cartridge is empty, may cause a very severe problem. A certain quantity of dentifrice material still can be pumped from the pump chamber, channels and other areas outside of the spent cartridge, but this causes the formation of voids in these places. Such over pumping may result in a breakdown of the vacuum force that is required for efficient pump operation and a consequent failure to pump any dentifrice material from a new cartridge.

One way to avoid over-pumping involves the user's monitoring of the position of the follower disc through a viewing port in the handle. A viewing port as described in U.S. Pat. No. 4,787,765 allows the user to determine when the cartridge is nearly empty by observing the position of the follower disc. However, this approach does not ensure a failure-free operation of the toothbrush since the user may neglect to observe the position of the follower disc through the viewing port and to refrain from further pumping when the cartridge is empty. It is therefore desireable to have a self-locking mechanism built into the toothbrush to prevent the user from further pumping when the cartridge has reached a near empty state.

Another problem originates when a spent cartridge is being removed and is caused by the adhesiveness of the dentifrice material. As the spent cartridge is removed, some residual material sticks to the follower disc and material remains attached to the pump mechanism within the brush handle. In the configurations of a replaceable cartridge and a pumping piston as described in U.S. Pat. No. 4,787,765, dentifrice material adheres to the follower disc during removal of a spent cartridge. The material adhering to the follower disc is removed from part of the material in the pump chamber. Similar to the previously described over-pumping situation, the quantity of dentifrice material that is pulled out of the pump chamber by its adherence to the follower disc, is not replaced when a new cartridge is inserted. Consequently, upon insertion of the new cartridge, voids are created which may deteriorate pumping efficiency and result in a complete pump failure.

There is a need for a dentifrice dispensing toothbrush which efficiently overcomes problems that are caused by over-pumping and by the adhesive consistency of paste-like dentifrice materials. More specifically, there is a need for a cartridge toothbrush which pumps and prevents further pumping when its cartridge is empty and retains sufficient amount of material within its handle as the spent cartridge is removed to prevent the formation of voids when a new cartridge is inserted. There is also a need for a dentifrice dispensing toothbrush that has a brush head that can be conveniently and thoroughly cleaned of material that adheres to the bristles and clogs the feed opening after each use.

It is therefore an object of this invention to provide a toothbrush with a replaceable cartridge containing dentifrice material which ensures a continuous flow stream of dentifrice material when it is pumped therethrough.

It is a further object of the invention to provide a toothbrush for storing dentifrice material which can be easily and efficiently cleaned after each use.

SUMMARY OF THE INVENTION

In accordance with the present invention, a dentifrice dispensing toothbrush is provided which efficiently pumps a controlled quantity of dentifrice material in void free condition from a replaceable cartridge to the brush head. The invention also includes a dentifrice dispensing toothbrush which has a detachable brush head that is easily and thoroughly cleanable of residual dentifrice material that remains after the brush is used. The essential components of the toothbrush of the present invention include (1) a housing which has a body and a neck, (2) a reservoir situated within the housing body, (3) a removable cartridge positioned within the reservoir for storing dentifrice material, (4) a pumping means comprising a piston with an orifice for applying a pumping force to the dentifrice material to cause a controlled quantity of it to flow from the cartridge and through its orifice, (5) a brush head having a platform with an opening therethrough and to which a series of bristles are attached, (6) a plunger for driving the piston which is attached to the neck of the housing and to the brush head, and (7) a hollow conduit within the plunger having one of its ends in communication with the piston orifice and having its remaining end in communication with the opening in the platform of the brush head so that dentifrice material is able to flow through the hollow conduit and through the opening in the platform to the brush head when a pumping force is applied.

In order to eliminate the formation of voids in the dentifrice material when a removable cartridge with a follower disc is used, the dentifrice dispensing toothbrush of this invention includes a locking means for preventing movement of the piston when a pumping force is applied and the follower disc is at its terminal position. As discussed in more detail later, the follower disc reaches its terminal position when the useful content of the dispenser has been depleted. The locking means comprises one or more spacers which are disposed between the piston and the follower disc and which are attached to the piston and/or the follower disc. When the spacers, piston and follower disc are in mutual contact, the plunger is immovable and the pumping mechanism is locked. The dimensions of the spacers are designed to be sufficient to allow the terminal position of the follower disc to retain a small quantity of material in the cartridge which is equivalent to the amount adhering to the follower disc as the spent cartridge is pulled out. Thus, when the cartridge is removed, a sufficient quantity of material sticks to the piston and reservoir walls so that no voids are formed when a new cartridge is inserted. Consequently, when pumping is resumed from a replacement cartridge, a continuous flow of dentifrice material is pumped to the brush head without pumping deterioration or failure. The self-locking feature eliminates the need for the user to monitor the position of the follower disc through a port to ascertain when the cartridge is ready for replacement.

In order to facilitate the removal of residual dentifrice material from the bristles and from the opening in the brush head which remains after the brush is used, the toothbrush of this invention includes a detachable brush head which is slidably attached to the end of the plunger. The brush head is completely detachable or is slidable to any one of three positions in relation to the end of the hollow conduit in the plunger. In the open position, the opening in the brush platform is aligned with the end of the hollow conduit in the plunger thus permitting the passage of dentifrice material from the hollow conduit, through the opening and to the brush head. In the blocking position, the opening in the brush platform is blocked by the plunger and the end of the hollow conduit is blocked by the platform of the brush head thereby preventing the flow of dentifrice material through the hollow conduit to the detachable brush head. In the cleaning position, the opening in the brush platform is exposed beyond the end of the plunger thereby permitting thorough cleaning of the platform opening and bristles by the passage of water or other cleaning fluid through both sides of the opening.

The dentifrice dispensing toothbrush of the invention as described herein eliminates significant pumping and cleaning problems caused by the adhesive consistency of paste-like dentifrice materials. The locking means for preventing pumping of residual material from the pump chamber, channels and other areas in the reservoir after the useful content of the cartridge has been pumped therefrom, eliminates voids and erratic flow when material is subsequently pumped from a replacement cartridge. The slidable and detachable brush head allows better access to the opening in the brush head platform. This facilitates the entry of a rinsing fluid such as water for cleaning residual dentifrice material lodged in the opening and the bristles without effecting the supply of material in the hollow conduit adjacent to the brush head.

The invention and its objects and advantages will become more apparent by referring to the accompanying drawings and to the ensuing detailed description of the preferred embodiment.

DETAILED DESCRIPTION OF THE PREFERRED EMBODIMENTS

Figure 1:
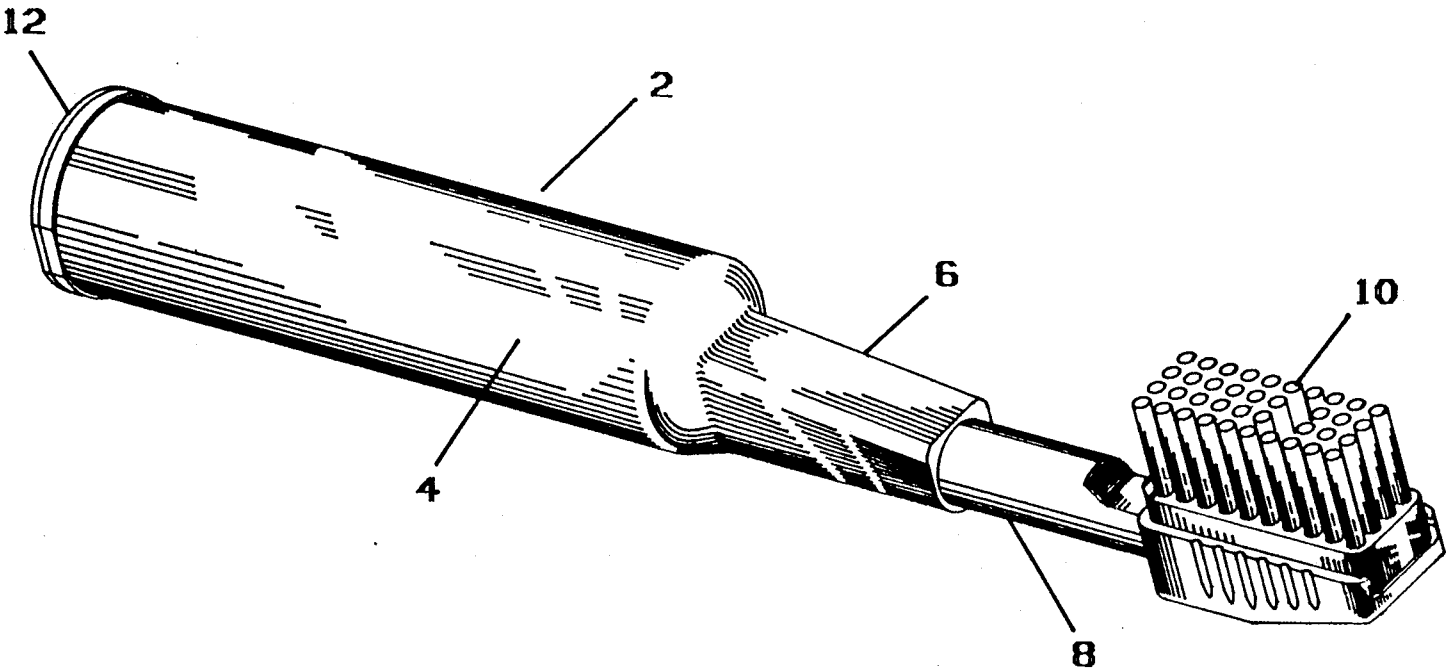
FIG. 1 is a perspective view of a dentifrice dispensing toothbrush according to this invention.

As shown in FIG. 1, the dentifrice dispensing toothbrush of this invention includes housing 2 having neck 6 and body 4. One end of plunger 8 is attached to neck 6 while the remaining end of plunger 8 is attached to brush head 10. Dentifrice material is stored in a removable cartridge situated in a reservoir within body 4. Cap 12 is positioned at the base of housing 2 and is attached to the cartridge.

Figure 2:
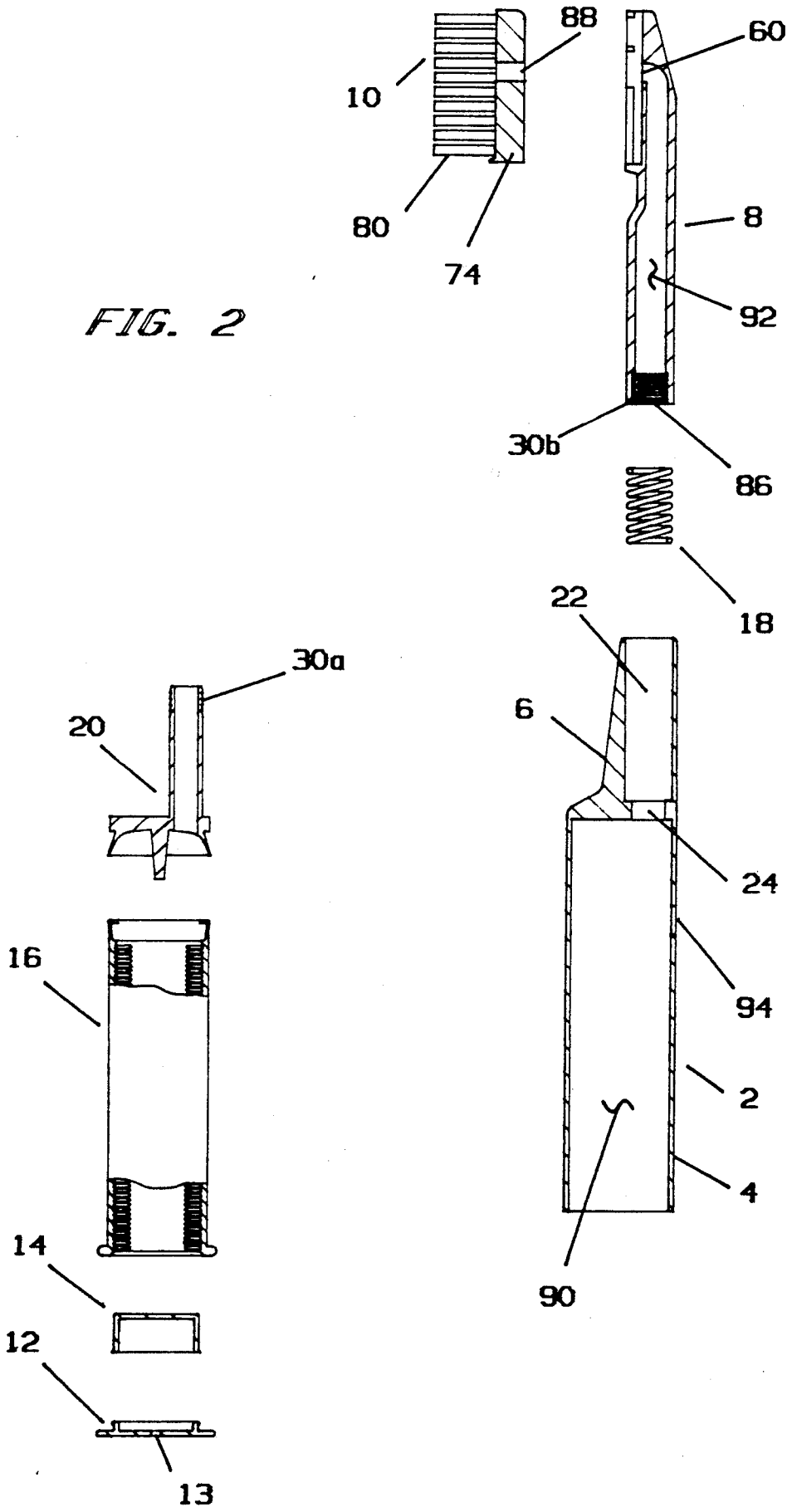
FIG. 2 is an orthographic view of the unassembled parts of the dentifrice dispensing toothbrush of this invention.
Figure 5A:
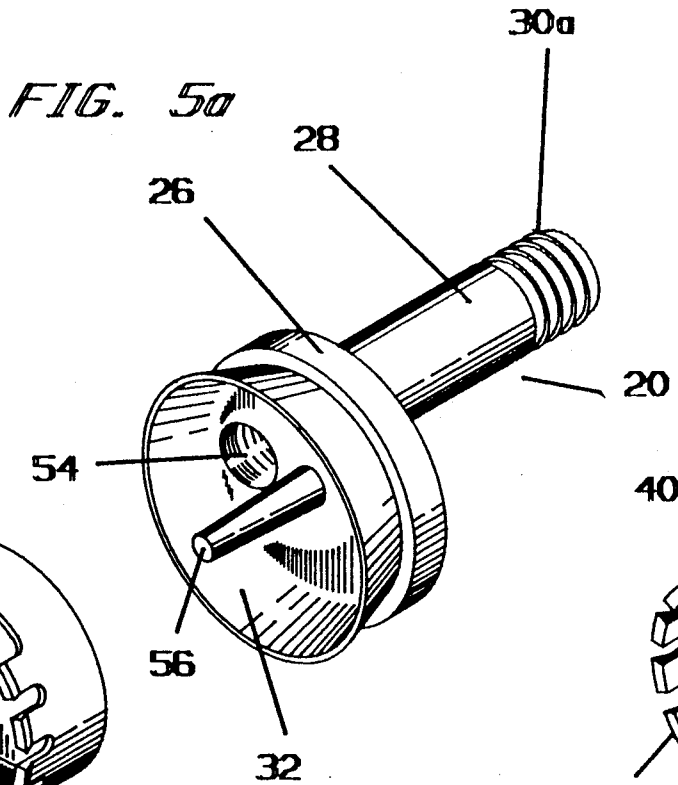

The basic components of the toothbrush of the invention are shown in FIG. 2 for the embodiment that utilizes a removable cartridge. Piston 20 is used to pump dentifrice material from the cartridge. It has a stem 28 and a head 26 as shown in FIG. 5*a*. An orifice 54 extends through head 26 and stem 28 to provide an opening for the passage of dentifrice material that is removed from the cartridge when a pumping force is applied by piston 20. The piston is placed in housing 2 so that all or part of stem 28 is positioned in neck 6 and head 26 is positioned in body 4. Flexible sealing lip 32 which is conformable to the cross sectional shape of the interior of body 4 is attached to head 26. Flexible sealing lip 32 ensures that piston 20 remains firmly in place and prevents dentifrice material from leaking around the periphery of head 26 when a pumping force is applied. Spacing elements or spacers 56 are extended from head 26 and are attached thereto. Spacers 56 lock the piston by preventing its movement when the useful content of the cartridge has been depleted and follower disc 14 has reached its terminal position.

In further reference to FIG. 2, cartridge 16 is placed in reservoir 90 within body 4 of housing 2. The cartridge contains dentifrice material which is pumped therefrom to brush head 10 by passing through a series of openings, an orifice and a conduit. Follower disc 14 is inserted at the base of the cartridge and advances within the cartridge as dentifrice material is pumped therefrom until it reaches its terminal position. Base cap 12 having hole 13 is placed on the base of the cartridge after the follower disc has been inserted. Hole 13 ensures that atmospheric pressure is maintained on the cap side of the follower disc. The removable cartridge can be of any shape so long as its shape is compatible with the shape of reservoir 90.

Figure 3:
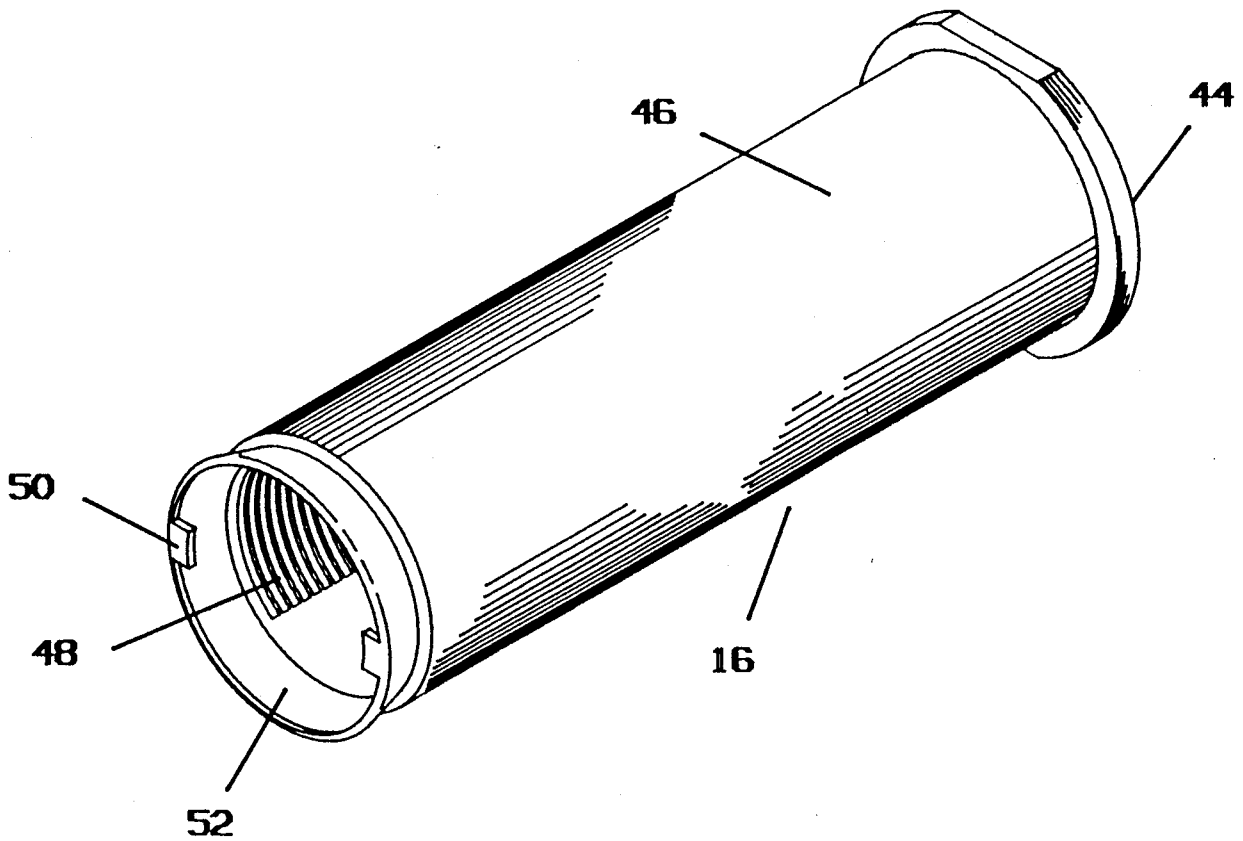
FIG. 3 is a perspective view of a removable cartridge which is inserted into the housing of the toothbrush.
Figure 5B:
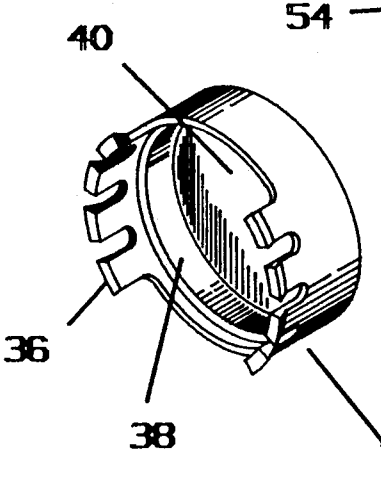

More detail concerning the cartridge and follower disc are shown in FIGS. 3 and 5*b*. Removable cartridge 16 is a hollow cylinder with wall 46 and flanged base 44 on one end, which also serves as the base for housing 2. Follower disc 14 is mounted in the flanged base end of cartridge 16 to prevent backflow of dentifrice material when a pumping force is applied to the cartridge. The center part 40 of disc 14 has a shape which is conformable to cylinder base 44. Backflow of dentifrice material is prevented by annular lip 38 of disc 14. The width of lip 38 is such so as to provide a snug fit with the internal wall of the cartridge to enhance its sealing capability.

Cartridge 16 also has a flexibly flared end 52 positioned at its other end. A pair of oppositely disposed retention tabs 50 are situated on the inner wall surface of the cartridge at flared end 52. The external width of the cartridge at its flexibly flared end 52 is slightly greater than the internal width of the reservoir. Flexibly flared end 52 thereby provides a seal to prevent dentifrice material from leaking when it is under a pumping force. The distance between the oppositely disposed retention tabs 50 is less than the width of disc 14 to prevent movement of the disc beyond the tabs. This arrangement ensures that disc 14 and cartridge 42 are removed from the reservoir together when the cartridge is replaced.

As dentifrice material is pumped from cartridge 16, follower disc 14 slides from the flanged end toward the open end of the cartridge. Backward movement, i.e. movement of the disc toward the flanged base 44 of cartridge 16, is prevented by a plurality of flexible, radially extending fingers 36 which are positioned on the circumference of disc 14. The maximum width of the disc including the fingers is greater than the internal width of cartridge 16. Thus, when disc 14 is positioned in cartridge 16, the tips of fingers 36 contact the inner wall of cartridge 16. The stubbing force resulting from this contact prevents the backward movement of disc 14. In a preferred embodiment, the inner surface of wall 46 contains a series of grooves 48 having an angular pitch which enhances the uni-directional movement of disc 14. Backward movement of disc 14 is further prevented when the tips of fingers 36 are mated in position with grooves 48.

Cartridge 16 containing dentifrice material is inserted in reservoir 90. Follower disc 14 seals the bottom end of cartridge 16 and ensures that dentifrice material flows only from the open end of cartridge 16. Cartridge 16 is removable. Thus, when the useful contents of the cartridge are depleted, the spent cartridge is removed and replaced with a full cartridge which is inserted into reservoir 90.

Figure 4:
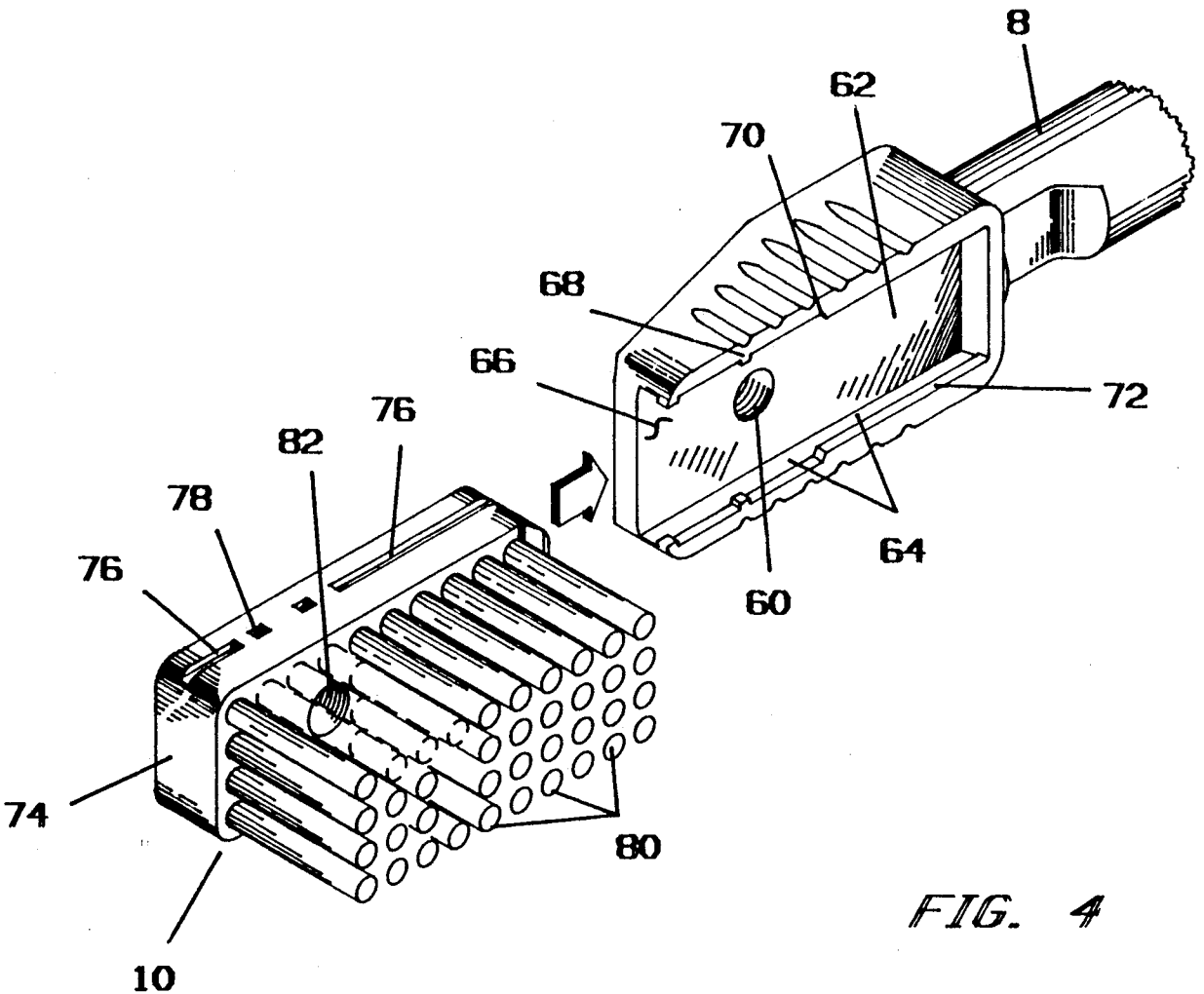
FIG. 4 is a perspective view of a detachable brush head and supporting channel of the dentifrice dispensing toothbrush of this invention.

Referring again to FIG. 2, spring 18 is positioned in the base of well 22 contained within housing neck 5. Plunger 8 is slidably mounted in well 22 and is connected to piston 20 by the union of threading 30*a* at the end of piston stem 28 (FIG. 5*a*) with threading 30*b* at the end of the plunger. In its initial position, piston stem 28 is situated within spring 18. When assembled, the arrangement of plunger 8, spring 18 and piston stem 28 allows them to move in concert and causes them to return to their initial position after a pumping force is applied. The operation of these components is discussed in more detail elsewhere in this section. The other end of plunger 8 is attached to brush head 10. The plunger contains a hollow conduit 92 which is coextensive with most of the length of the plunger. One end of conduit 92 terminates at opening 86 while the remaining end terminates at opening 60 which is positioned at the base of channel 66. Plunger channel 66 forms an end of plunger 8 as shown in FIG. 4. Channel 66 includes base 62, side walls 64, retention rib 72, detent notches 68 and shoulders 70. The configuration of channel 66 allows for the brush head 10 to be slidable to various positions while remaining seated in the channel or to be detachable from the plunger by sliding completely out of the channel.

Brush head 10 as shown in FIGS. 2 and 4 contains a series of bristles 80 that are attached to platform 74. Platform 74 contains an opening 88. Bristles 80 are configured so as to form opening 82 which is a continuation of opening 88. The side of platform 74 includes retention slot 76 and detent recesses 78. As brush head 10 is slid into channel 66, retention slot 76 mates with retention rib 72 to guide the brush head into position during the attachment process. The brush head is locked in one of three positions by the engagement of detent notches 68 with detent recesses 78. In the pumping position, brush head 10 is positioned in channel 66 so that openings 88 and 60 are aligned and in communication with each other. In the blocking position, brush head 10 is positioned so that opening 88 is not aligned with opening 60 but instead is blocked by channel base 62. In the cleaning position, brush head 10 is positioned such that opening 88 is beyond the end of channel 66 while the brush head is still attached to the plunger channel. In this position the brush head is fully extended with opening 88 being unobstructed and fully accessible for the application of water or other fluid for cleaning the passageway and thoroughly rinsing the bristles.

FIGS. 8*a* through 8*e* show the sequential positions of the components for the five stages in an operating cycle of the toothbrush. In the first stage (FIG. 8*a*) opening 88 of brush head 10 is in a closed position wherein it is not aligned with opening 60 of plunger conduit 92. Dentifrice material contained in conduit 92 is blocked from flowing to bristles 80 by platform 74. Piston 20 is in a non pumping position and plunger 8 is maintained in its fully extended position by spring 18. The toothbrush is normally stored in this stage during periods of non use.

Figures 8A, 8B, 8C, 8D, 8E:
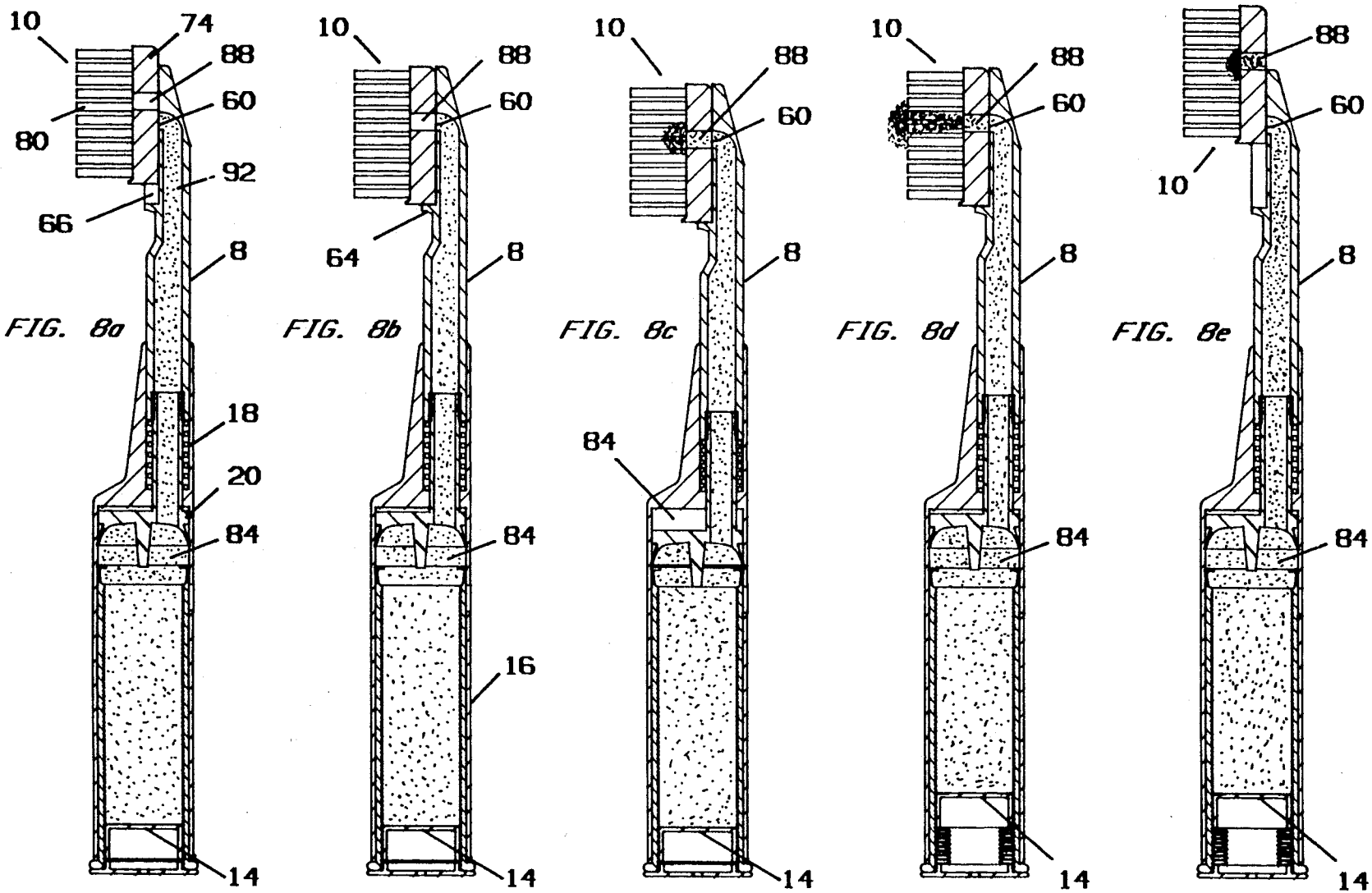
FIGS. 8*a* through 8*e* are orthographic views of the toothbrush showing the relative positioning of parts for each step of an operating cycle.

In the second stage, FIG. 8*b*, brush head 10 is slidably moved to its open position wherein opening 60 and opening 88 are aligned. Because the openings are in communication with each other, a continuous passage is established for the flow of dentifrice material from conduit 92 to bristles 80. The other components are maintained in the same positions that they had in the first stage.

Dentifrice material is pumped from cartridge 16 to brush head 10 in the third stage. As shown in FIG. 8*c*, brush head 10 remains in an open position while spring 18 is compressed by plunger 8 which is in a depressed position, causing a pumping force to be applied to piston 20. As piston 20 moves, it displaces dentifrice material on the cartridge side of pump chamber 84 and causes dentifrice material to be pumped through orifice 54, opening 86, conduit 92, openings 60 and 88 to brush head 10. A partial vacuum is then created on the plunger side of pump chamber 84.

In the fourth stage, as shown in FIG. 8*d*, the components and dentifrice material are in their ready for use positions. Piston 20 and plunger 8 are in their initial, at rest positions and a controlled quantity of dentifrice material is positioned on bristles 80 of brush head 10. Openings 60 and 88 remain aligned but no additional material is pumped therethrough during brushing action. Before reaching their ready for use positions, plunger 8 and piston 20 are caused to return to their original positions by the reaction force of spring 18 when the pumping force is discontinued. At the same time, a pressure lower than atmospheric is thus created on the cartridge side of pump chamber 84 which causes a volume of dentifrice material, which is equivalent to the displacement volume of the pump chamber, to advance from the cartridge with piston head 26 and to occupy space equivalent to that previously created on the plunger side of pump chamber 84. As dentifrice material moves toward piston head 26, follower disc 14 simultaneously moves in the same direction due to the pressure difference. As previously explained, the movement of follower disc 14 is uni-directional because of the locking action provided by the positioning of fingers 36 into grooves 48 in wall 46 of cartridge 16. The displacement volume of pump chamber 84 corresponds to the quantity of dentifrice material deposited on brush head 10 during one application. This controlled quantity ensures that excessive dentifrice is not used thereby minimizing waste and enhancing efficiency.

After the toothbrush is used, it is placed in its final stage by slidably moving brush head 10 in channel 66 to a cleaning position as shown in FIG. 8*e*. In this stage, brush head 10 remains attached to plunger 8 but is fully extended in channel 66 so that platform opening 88 is fully exposed. Dentifrice material which remains in bristles 80, opening 82 and opening 88 after the toothbrush is used, is efficiently removed by applying a rinsing fluid such as water to the bristles and exposed opening 88. The positioning of the other components remains the same as they were in the preceding stage. After rinsing of the brush head is completed, the toothbrush is returned to its first stage configuration for storage as shown in FIG. 8*a*.

Figure 7A:
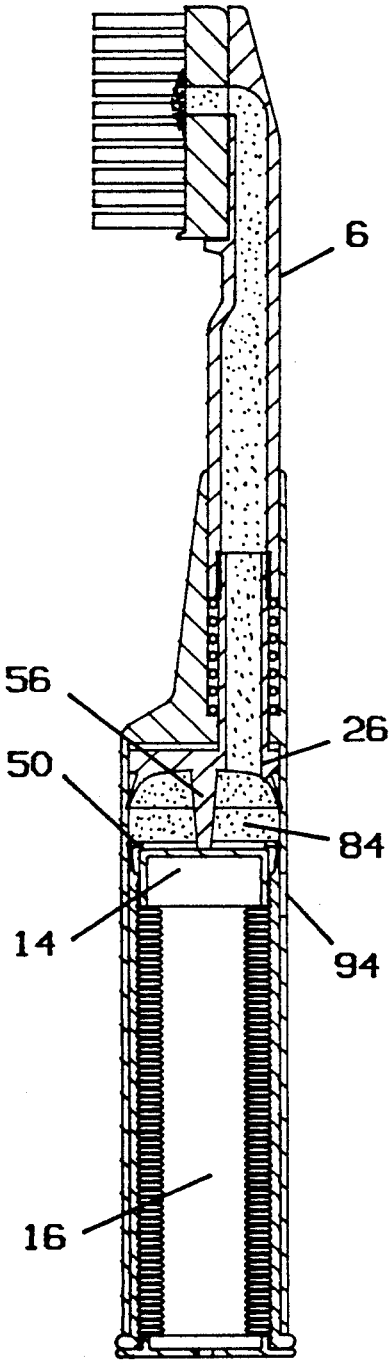
FIG. 7*a* is an orthographic view of the toothbrush of this invention showing the positioning of the piston and follower of FIGS. 5*a* and 5*b* respectively in an empty cartridge.

When the content of cartridge 16 is depleted, follower disc 14 is situated in its terminal position near the end of cartridge 16 as shown in FIG. 7*a*. When the follower disc is in its terminal position, it is prevented from advancing further in the cartridge by one or more spacers 56 which are attached to piston head 26 and extend beyond sealing lip 32. Backward movement of the follower disc is prevented by the contact of the tips of fingers 36 with the inner wall of cartridge 16. Piston head is also rendered immovable from its original position in chamber 84 by contact of the spacers with the follower disc when it is in its terminal position. In this position, the follower disc is immovable and the spacers block any movement of the piston head in the pump chamber. Thus, plunger 8 cannot be depressed to provide a pumping force to piston 20. The toothbrush therefore automatically locks the plunger and piston when the useful contents of cartridge 16 are depleted.

The spent cartridge is removed by extracting it from the base of reservoir 90. Retention tabs 50 ensure that follower disc 14 remains in the cartridge as it is removed. A new cartridge filled with dentifrice material is inserted into the reservoir. As it is moved forward into the reservoir, trapped air is vented through port 94. After the new cartridge is fully positioned and its useful contents become depleted, port 94 serves as a gauge for viewing when the follower disc reaches its terminal position.

If a spacer is not used, piston 20 will continue to pump the residual dentifrice material in chamber 84 after the cartridge is empty. When the spent cartridge is replaced with a new one filled with dentifrice material, chamber 84, orifice 54 and conduit 92 have a significant volume of voids which adversely effects pumping efficiency. Moreover, when a pumping force is applied, irregular quantities of dentifrice material are dispensed and the flow is not smooth and continuous. Furthermore, when the pumping force is released, the voids have a tendency to become larger because the follower disc advances less than it should due to an inadequate vacuum force. Eventually, it fails to pump any dentifrice material due to a complete breakdown of the vacuum force.

The spacers are positioned between the piston head and the follower disc and are attached to either or both parts. Also, multiple spacing elements can be used. They are positioned so that contact is made with the follower disc when it is in its terminal position. A spacer can be of any configuration or shape so long as it does not block the flow of dentifrice material. A spacer in the form of a rod which has a cross section which is smaller than the cross section of the follower disc or piston head, is particularly suitable. The spacer preferably has a length which is sufficient to ensure that the pump chamber remains filled with dentifrice material that is free of voids after the useful contents of the cartridge have been depleted and the cartridge replaced. The useful content of the cartridge does not include the quantity that remains in the cartridge after the follower disc has reached its terminal position. Because of its adhesive nature, a small quantity of dentifrice material is removed from the end of the pump chamber when the spent cartridge is removed. The spacer may have a length that stops the follower disc at its terminal position while a small quantity of dentifrice material still remains in the cartridge. This small quantity of material offsets the small quantity that otherwise would be removed from the chamber due to material adhesion when the spent cartridge is removed. This further reduces the formation of voids when material is pumped from the new cartridge. Prior to the insertion of a new cartridge, the opening of the brush head is aligned with the opening of the plunger conduit so that any excessive dentifrice material remaining in the pump chamber is forced out during the insertion of the new cartridge.

Figure 6A:
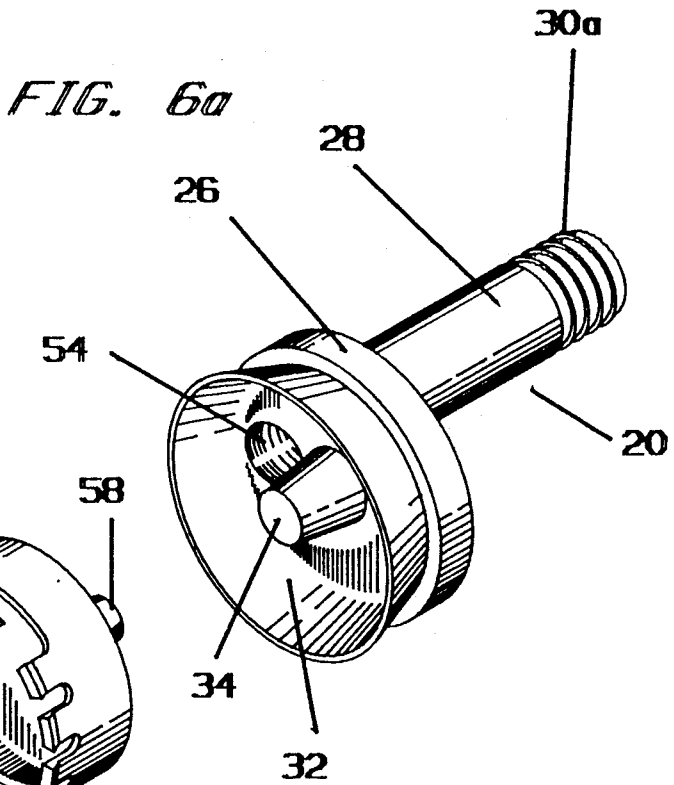
FIGS. 5*a* and 6*a* are perspective views of different embodiments of a piston which is positioned within the housing of the toothbrush.
Figure 6B:
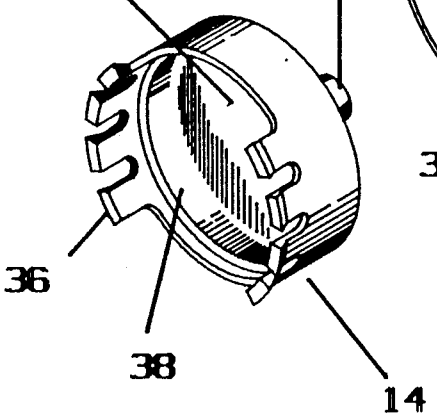
FIGS. 5*b* and 6*b* are perspective views of different embodiments of a follower disc which is positioned in the removable cartridge of FIG. 3.
Figure 7B:
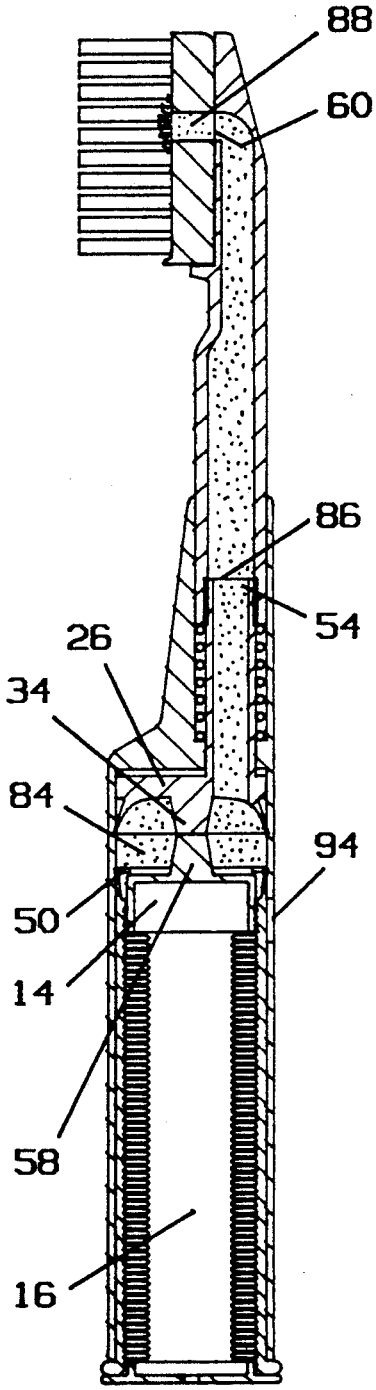
FIG. 7*b* is an orthographic view of the toothbrush of this invention showing the positioning of the piston and follower of FIGS. 6*a* and 6*b* respectively in an empty cartridge.

The toothbrush shown in FIG. 7*b* utilizes a spacer 58 which is attached to the follower disc as shown in FIG. 6*b* and a spacer 34 which is attached to the piston as shown in FIG. 6*a*. The spacers contact each other when the follower disc is in its terminal position thereby locking the plunger and piston in place.

The invention has been described in detail with reference to a preferred embodiment thereof. However, it will be understood that variations and modifications can be effected within the spirit and scope of the invention. For example, the toothbrush can optionally be provided with a cap to seal opening 60 and to protect brush head 10 during periods of non-use. The cap can be in the form of a cover which is compatible in size and shape with housing 2 and removably attached thereto. Also, brush head 10 can be attached to plunger 8 in a stationary, fixed position rather than in a manner which renders it slidably movable and detachable from plunger 8. As another alternative, it can be attached in a manner wherein it is either slidable but not detachable, or detachable but not slidable. Moreover, the advantages of the invention can be achieved, at least in part, by using means other than a removable cartridge for supplying dentifrice material to the toothbrush. In this regard, the material can be provided in any suitable type of refillable container, or it can be stored directly in the reservoir in the brush handle. In another variation, the pumping means can be a piston which is in the form of a flexible and compressible wall with one end attached to the plunger and the other end fixed to the housing wall. In this variation, the spacer is configured to prevent movement of the piston when the follower disc reaches its terminal position.

I claim:

1. A dentifrice dispensing toothbrush comprising:

a. a housing having a body and a neck;

b. a reservoir situated in the body of the housing;

c. a removable cartridge positioned within the reservoir for storing dentifrice material, said removable cartridge comprising a hollow cylinder and a follower disc having a shape which is conformable to the shape of the cylinder base;

d. pumping means positioned within the housing and comprising a piston with an orifice for applying a pumping force to the dentifrice material to cause a controlled quantity of it to flow from the reservoir and through the orifice;

e. a brush head comprising a platform with an opening therethrough and a series of bristles which are attached to the platform;

f. a plunger for driving the piston and being slidably attached to the neck of the housing and to the brush head, said plunger being comprised of a hollow conduit having one of its ends in communication with the piston orifice and its remaining end in communication with the opening in the platform of the brush head, whereby dentifrice material flows through the hollow conduit and through the opening in the platform to the brush head when a pumping force is applied; and g. locking means for preventing movement of the piston when a pumping force is applied and the follower disc is at its terminal position, said locking means comprising a spacer which is in simultaneous contact with the piston and the follower disc when the follower disc is at its terminal position.

2. The dentifrice dispensing toothbrush described in claim 1 wherein the spacer is attached to the piston.

3. The dentifrice dispensing toothbrush described in claim 1 wherein the spacer is attached to the follower disc.

4. The dentifrice dispensing toothbrush described in claim 1 wherein part of the spacer is attached to the follower disc and part of the spacer is attached to the piston.

5. The dentifrice dispensing toothbrush described in claim 1 wherein the pumping means is positioned within the housing.

6. The dentifrice dispensing toothbrush described in claim 1 wherein the piston includes a stem and a head with the orifice extending longitudinally through the piston stem and piston head.

7. The dentifrice dispensing toothbrush described in claim 1 wherein the brush head is detachable from the plunger.

8. The dentifrice dispensing toothbrush described in claim 1 wherein the plunger is slidably attached to the neck of the housing.

9. The dentifrice dispensing toothbrush described in claim 1 wherein the removable cartridge comprising a hollow cylinder has a grooved inner wall surface and the follower disc having a shape which is conformable to the shape of the cylinder base is slidably mounted within the cylinder and has a plurality of flexible, radially extending fingers positioned on the circumference of the disc, the width of the disc including the flexible radially extending fingers being greater than the internal width of the cylinder whereby the ends of the flexible radially extending fingers are matable in the grooves of the inner wall surface.

10. A dentifrice dispensing toothbrush comprising:

a. a housing having a body and a neck;

b. a reservoir situated in the body of the housing;

c. a removable cartridge positioned within the reservoir for storing dentifrice material, said removable cartridge comprising a hollow cylinder and a follower disc having a shape which is conformable to the shape of the cylinder base;

d. pumping means comprising a piston with an orifice for applying a pumping force to the dentifrice material to cause a controlled quantity of it to flow from the reservoir and through the orifice;

e. a detachable brush head comprising a platform with an opening therethrough and a series of bristles which are attached to the platform; and f. a plunger for driving the piston, said plunger having one of its ends attached to the neck of the housing and its remaining end slidably attached to the detachable brush head, and being comprised of a hollow conduit wherein one end of said hollow conduit is in communication with the piston orifice and the remaining end of said hollow conduit is in communication with the platform of the detachable brush head;

wherein the detachable brush head is slidable to a position with respect to the plunger where the opening in the platform of the detachable brush head either (i) is in communication with the remaining end of the hollow conduit, thereby permitting flow of dentifrice material through the hollow conduit to the detachable brush head when a pumping force is applied, or (ii) is blocked by the plunger thereby preventing the flow of dentifrice material to the detachable brush head when a pumping force is applied, or (iii) is positioned beyond the end of the plunger thereby permitting the flow of fluid through the opening for cleaning the bristles and the opening.

11. The dentifrice dispensing toothbrush described in claim 10 wherein the piston includes a stem and a head with the orifice extending longitudinally through the piston stem and piston head.

12. The dentifrice dispensing toothbrush described in claim 10 wherein the pumping means is positioned within the housing.

13. The dentifrice dispensing toothbrush described in claim 10 wherein the plunger is slidably attached to the neck of the housing.

14. The dentifrice dispensing toothbrush described in claim 10 wherein the detachable brush head is slidable to a position with respect to the plunger where the opening in the platform of the detachable brush head is in communication with the remaining end of the hollow conduit, thereby permitting flow of dentifrice material through the hollow conduit to the detachable brush head when a pumping force is applied.

15. The dentifrice dispensing toothbrush described in claim 10 wherein the detachable brush head is slidable to a position with respect to the plunger where the opening in the platform of the detachable brush head is blocked by the plunger thereby preventing the flow of dentifrice material to the detachable brush head when a pumping force is applied.

16. The dentifrice dispensing toothbrush described in claim 10 wherein the detachable brush head is slidable to a position with respect to the plunger where the opening in the platform of the detachable brush head is positioned beyond the end of the plunger thereby permitting the flow of fluid through the opening for cleaning the bristles and the opening.

* * * * *